United States Patent [19]

Bucher

[11] Patent Number: 4,582,465

[45] Date of Patent: Apr. 15, 1986

[54] BLOWER FOR AIR SPRAY MASSAGE APPARATUS

[75] Inventor: Heinz Bucher, Rottweil, Fed. Rep. of Germany

[73] Assignee: Metronic Electronic GmbH, Fed. Rep. of Germany

[21] Appl. No.: 581,427

[22] Filed: Feb. 17, 1984

[30] Foreign Application Priority Data

Oct. 28, 1983 [DE] Fed. Rep. of Germany ..... 3339106

[51] Int. Cl.[4] ..... F04D 29/66; F01N 7/04

[52] U.S. Cl. ..... 415/119; 415/183; 415/219 R; 181/268; 181/238; 181/214; 417/312

[58] Field of Search ..... 418/181; 138/39, 44; 60/269, 726

[56] References Cited

U.S. PATENT DOCUMENTS

| | | | |
|---|---|---|---|
| 2,942,683 | 6/1960 | Moyer | 181/229 |
| 3,410,218 | 11/1968 | Fivel | 417/423 R |
| 3,695,781 | 10/1972 | LaBarber | 417/424 |
| 3,710,889 | 1/1973 | Lamy | 415/119 |
| 3,829,250 | 8/1974 | Samson, Jr. | 416/93 |
| 3,932,057 | 1/1976 | Wadensten | 415/119 |
| 3,994,364 | 11/1976 | Nicoll | 181/238 |
| 4,244,440 | 1/1981 | Matta et al. | 181/239 |

FOREIGN PATENT DOCUMENTS

| | | | |
|---|---|---|---|
| 7538228 | 4/1976 | Fed. Rep. of Germany . | |
| 7710580 | 8/1977 | Fed. Rep. of Germany . | |
| 0053512 | 4/1977 | Japan | 415/119 |
| 0785532 | 12/1980 | U.S.S.R. | 415/119 |

*Primary Examiner*—Edward K. Look
*Assistant Examiner*—H. Edward Li
*Attorney, Agent, or Firm*—Thomas W. Speckman

[57] ABSTRACT

A blower for an air spray bath massaging apparatus, which blower is operated by an electric motor and is enclosed in a housing having a suction air fitting and a compressed air fitting. To effectively reduce the suction noise of the blower, the suction air fitting is provided with a closure wall having a plurality of suction sleeves with suction inlets. The suction air current is divided into several smaller air currents by which considerably less suction noise is generated.

12 Claims, 3 Drawing Figures

BLOWER FOR AIR SPRAY MASSAGE APPARATUS

BACKGROUND OF THE INVENTION

This invention relates to a blower for an air spray bath massaging apparatus, which blower is operated by an electric motor and is enclosed in a housing having a suction air fitting and a compressed air fitting.

A blower of this general type is disclosed in German Utility Model DE-GM 75 38 228. To keep carbon dust away from the compressed air fitting, when a commutator motor is used for driving the blower, the compressed air fitting is provided with a filter of fine porous plastic foam inside the housing. Another filter, inserted in the suction air fitting, retains the dust from the air drawn in by suction action, so that only clean air is fed to the bubble grid which is connected to the compressed air outlet.

Another problem with blowers of this type relates to the noise produced by the moving parts and the air current. While the operational noise of the electric motor and the blower can be reduced to a minimum by a particularly meticulous execution of the mounting of individual parts, the noise produced by the air current fails to respond to any such conventional measure. This noise exceeds the operating noise of the motor and the blower combined and is generated mainly on the suction side because the suction opening of the suction air fitting in such blowers must be of a large diameter to admit the requisite volume of air.

SUMMARY OF THE INVENTION

It is the object of the present invention to greatly reduce by simple means the noise produced by the air current generated by suction action in the region of the suction air fitting.

This is accomplished according to the invention in that the suction air fitting is provided with a closure wall having a plurality of suction sleeves with their suction openings evenly spaced therein. By dividing the air current generated by suction action into several small partial air currents, it has been surprisingly found that the noise level could be reduced by a factor of 2 to 4. The total volume of the suction air current is determined by the diameter of the suction openings in the suction sleeves. For this purpose, one embodiment has been found particularly effective in which the suction sleeves are disposed to project from both the interior and the exterior side of the closure wall.

According to another embodiment, the suction sleeves are evenly spaced along a circular path on the suction fitting having a correspondingly enlarged diameter.

Further advantageous embodiments for noise reduction are characterized in that the diameter of the suction openings continuously decreases in the direction of suction, and that the suction sleeves project a greater distance from the exterior surface of the closure wall than from the interior surface of the closure wall.

According to another embodiment, the suction sleeves are joined to the closure wall of the suction air fitting by forming the suction sleeves in one piece therewith.

The installation of the structural unit comprising the electric motor and the blower in the housing is assisted in that the housing is made of two portions, whereby one housing portion has formed thereon the compressed air fitting and the other housing portion has formed thereon the suction air fitting including the closure wall with the suction sleeves thereon. Molding the suction sleeves in one piece with the respective housing portion will hardly affect the production costs as compared to a conventional blower, since this will merely increase somewhat the amount of material required for the respective housing portion.

BRIEF DESCRIPTION OF THE DRAWING

The invention will further be described with reference to a representative embodiment illustrated in the drawings, in which.

DESCRIPTION OF PREFERRED EMBODIMENTS

Figure 1:
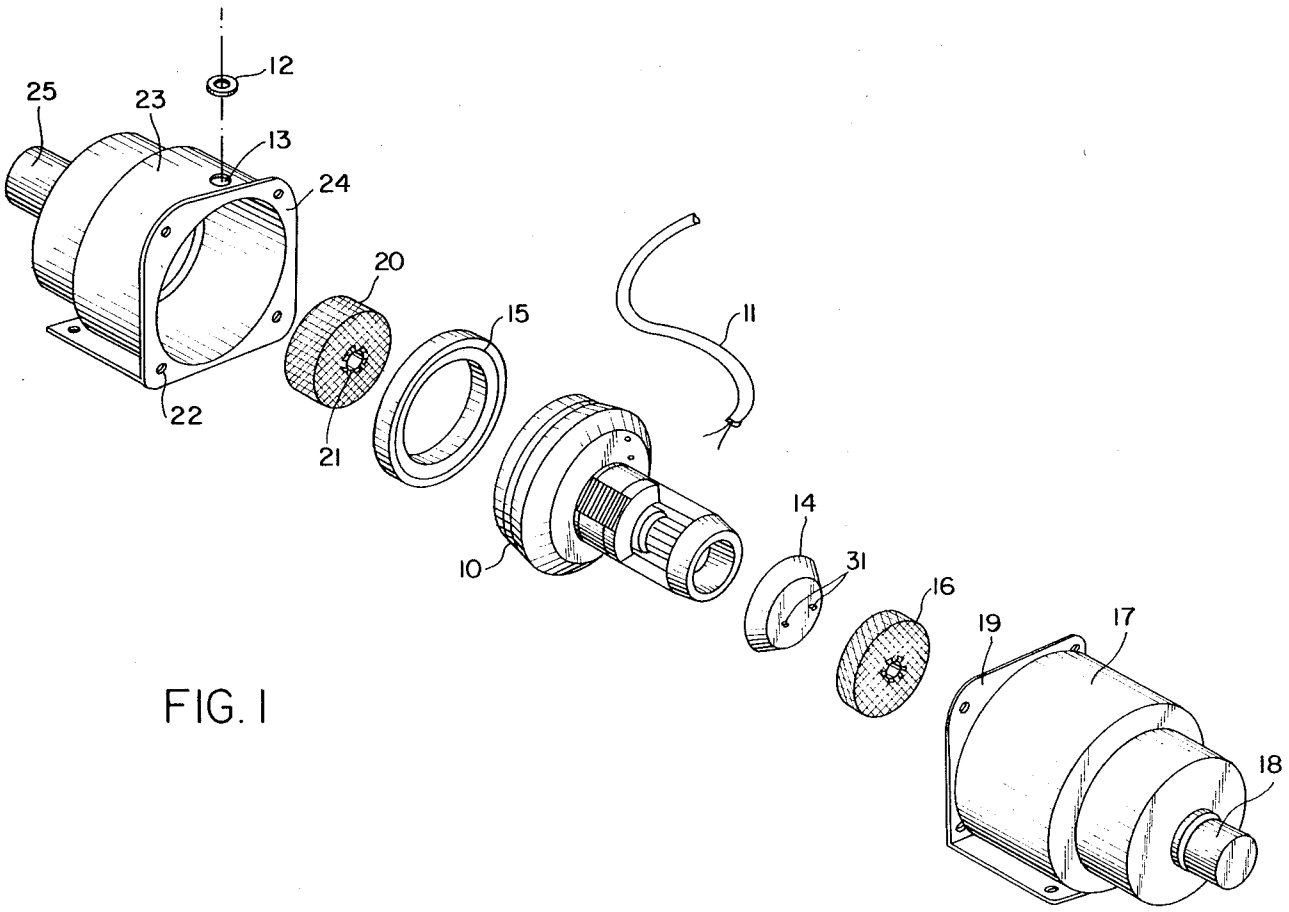
FIG. 1 is an exploded view of components of the blower.

The blower and the electric motor constitute a complete structural unit 10 which may additionally be provided with a heating coil for heating the air drawn in by suction. Connecting cord 11 for the electric motor and the heating coil is inserted into housing portion 23 through sealing 12 and bore 13. The two housing portions 17 and 23, facing each other with their open ends, are joined together on installing blower-motor unit 10. For this purpose, flanges 19 and 24 are provided with fastening holes 22 and a sealing member may be interposed. Blower-motor unit 10 is installed in the housing in such a manner that the cylinder on housing portion 17 serves as compressed air fitting 18 and the cylinder on housing portion 23 serves as the suction air fitting 25.

Prior to assembling the housing, filter discs 16 and 20 are inserted in compressed air fitting 18 and suction air fitting 25, respectively. Filters 16 and 20 are a fine porous plastic foam. Filters 16 and 20 completely cover the suction inlet opening and the compressed air outlet opening of the blower, to retain any dust which may be in the air drawn in by suction action and prevent carbon dust and other dirt particles released by the electric motor and the blower from passing through compressed air outlet 18 to the bubble grid connected thereto. Center holes 21 in filter discs 16 and 20 serve to secure the filter discs in housing portions 17 and 23.

Blower-motor unit 10 is in operational contact with the offset section of housing portion 23 by way of sealing ring 15 outside suction air fitting 25. The other end of blower-motor unit 10 is in close direct contact with the inlet of compressed air fitting 18 by way of buffer or supporting disc 14. Supporting disc 14 may be secured by elements of housing portion 17 in combination with holes 31 in disc 14 and the center hole in filter 16.

Figure 2:
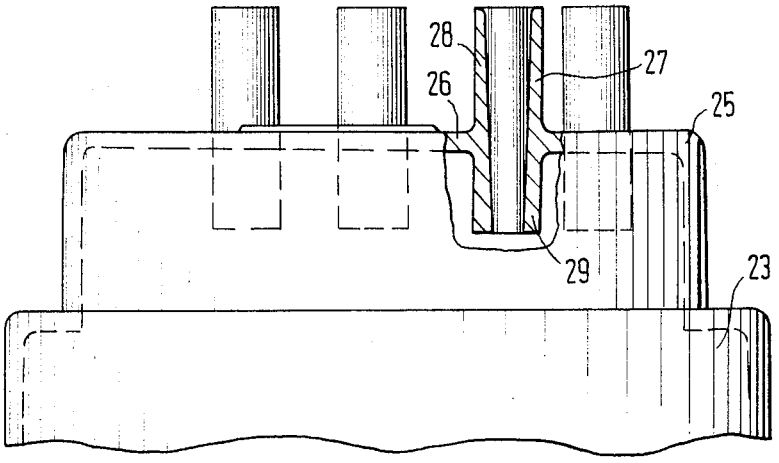
FIG. 2 is a side partial sectional view along line 2—2 of the housing portion provided with the suction air fitting.
Figure 3:
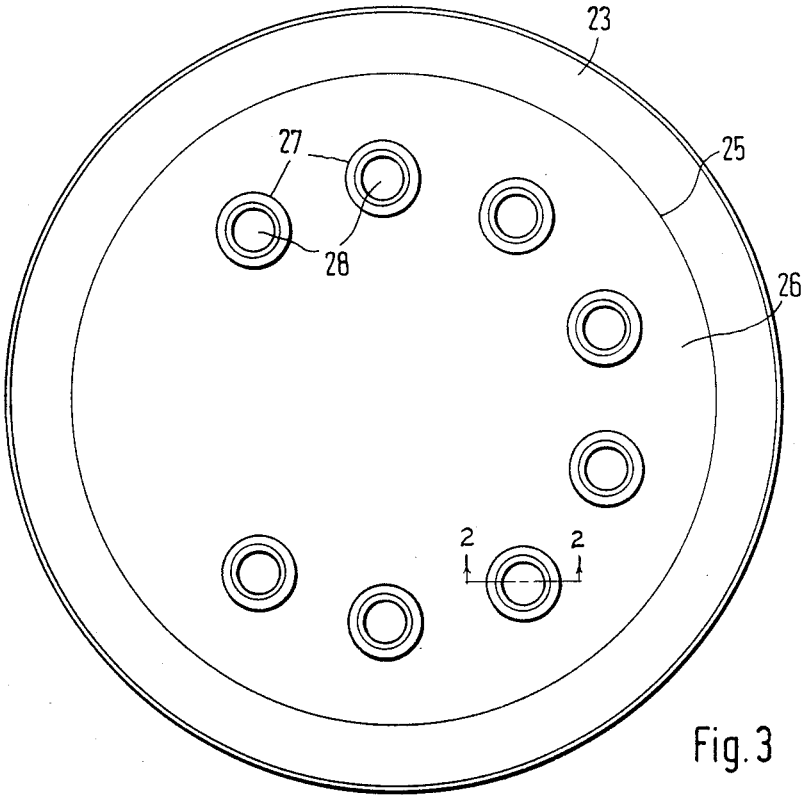
FIG. 3 is a plan view of the exterior side of the suction air fitting.

As is shown in the enlarged views of FIGS. 2 and 3, suction air fitting 25 is closed by closure wall 26. Disposed in closure wall 26 are a plurality of suction sleeves 27 which are preferably evenly spaced along a circular line concentric with the center of suction air fitting 25. Suction sleeves 27 are molded in one piece with closure wall 26 of suction air fitting 25, keeping the production of housing portion 23 cost effective. Suction sleeves 27 with their inlet openings 28 represent the means for dividing the air current drawn in by suction into a plurality of equal, smaller partial currents so that the suction noise is considerably reduced. To this end, it is of advantage that suction sleeves 27 project from both the exterior and the interior surface of closure wall 26. It has been found useful to have suction sleeves 27 project farther from the exterior side of closure wall 26 than from the interior side. A further reduction in noise is attained by continuously decreasing the diameter of suction inlets 28 in the direction of suction. This will moreover assist in the molding of the housing portion 23 if manufactured by plastic injection molding.

I claim:

1. Blower for an air spray bath massaging apparatus operated by an electric motor and enclosed in a housing having a suction air fitting on one side of said blower and a compressed air fitting on the opposite side of said blower, characterized in that said suction air fitting (25) is provided with an end closure wall (26) having a plurality of suction sleeves (27), each said suction sleeve projecting from at least one of an interior surface facing said blower and an exterior surface of said end closure wall and integral with and evenly spaced in said end closure wall (26), each said suction sleeve (27) having a suction opening (28) therethrough, the diameter of each said suction opening (28) continuously decreasing toward said blower.

2. Blower according to claim 1, characterized in that said suction sleeves (27) are disposed to project from both the interior and the exterior side of said closure wall (26).

3. Blower according to claim 2, characterized in that said suction sleeves (27) are evenly spaced along a circular path.

4. Blower according to claim 5, characterized in that said suction sleeves (27) project a greater distance from the exterior surface of said closure wall (26) than from the interior surface of said closure wall (26).

5. Blower according to claim 4, characterized in that said suction sleeves (27) are joined to said closure wall (26) of said suction air fitting (27) by molding them in one piece therewith.

6. Blower according to claim 5, characterized in that said housing is made of two separate portions (17, 23), whereby one said housing portion (17) has formed thereon a compressed air fitting (18) and the other said housing portion (23) has formed thereon said suction air fitting (25) including said closure wall (26) with said suction sleeves (27) molded thereon.

7. Blower according to claim 6, characterized in that each said suction opening is of equal size.

8. Blower according to claim 2, characterized in that said suction sleeves (27) project a greater distance from the exterior surface of said closure wall (26) than from the interior surface of said closure wall (26).

9. Blower according to claim 1, characterized in that said suction sleeves (27) are evenly spaced along a circular path.

10. Blower according to claim 1, characterized in that said suction sleeves (27) are joined to said closure wall (26) of said suction air fitting (27) by molding them in one piece therewith.

11. Blower according to claim 1, characterized in that said housing is made of two separate portions (17, 23), whereby one said housing portion (17) has formed thereon a compressed air fitting (18) and the other said housing portion (23) has formed thereon said suction air fitting (25) including said closure wall (26) with said suction sleeves (27) molded thereon.

12. Blower according to claim 1, characterized in that each said suction opening is of equal size.

* * * * *